US005739507A

United States Patent [19]

Hochgesang

[11] Patent Number: 5,739,507

[45] Date of Patent: Apr. 14, 1998

[54] KEYBOARD FOR CASH REGISTERS AND OTHER REGISTERS

[75] Inventor: Gerhard Hochgesang, Bad Neustadt, Germany

[73] Assignee: Preh-Werke GmbH & Co. KG, Bad Neustadt, Germany

[21] Appl. No.: 592,685

[22] Filed: Jan. 26, 1996

[30] Foreign Application Priority Data

Feb. 24, 1995 [DE] Germany ..... 195 06 509.3

[51] Int. Cl.[6] ..... G06C 7/02; G06C 25/00; G07G 1/00

[52] U.S. Cl. ..... 235/145 R; 235/26

[58] Field of Search ..... 235/7 R, 145 R, 235/146, 26

[56] References Cited

U.S. PATENT DOCUMENTS

| | | | |
|---|---|---|---|
| 3,323,717 | 6/1967 | Bellis . | |
| 3,623,081 | 11/1971 | Scarbrough | 340/365 |
| 3,646,551 | 2/1972 | Bretti et al. | 340/365 |
| 3,717,235 | 2/1973 | Dannatt | 197/98 |
| 4,351,988 | 9/1982 | Allbright | 200/5 A |
| 4,594,481 | 6/1986 | Wilham et al. | 200/5 A |
| 5,430,263 | 7/1995 | English et al. | 200/5 A |

FOREIGN PATENT DOCUMENTS

| | | |
|---|---|---|
| 42 09 437 A1 | 9/1993 | Germany . |
| 44 05 754 A1 | 8/1995 | Germany . |

OTHER PUBLICATIONS

Casio, "Elektronische Registrierkasse mit Standard—und Folientastatur"; advertisement; undated.

*Primary Examiner*—Michael L. Gellner
*Assistant Examiner*—Daniel Chapik
*Attorney, Agent, or Firm*—Griffin, Butler, Whisenhunt & Kurtossy

[57] ABSTRACT

A keyboard for cash registers and other registers of a type having long and short stroke keys (3) allows a structural reconfiguration for meeting various needs of customers. The keyboard, with all keys (3) thereof being at uniform key spacings, includes short-stroke rocker key assemblies (5) with short key moment arms (7) and a long switch moment arms (8) and long-stroke rocker key assemblies (4) with long key moment arms (7') and short switch moment arms (8'). When mounted, a key of a long-stroke rocker key assembly (4) is within a bifurcated end of a forked lever (9) of a respective adjacent long-stroke rocker key assembly. By making the long-stroke rocker key assemblies with forked levers in which keys of adjacent long-stroke rocker key assemblies are positioned, the keyboard can be adapted to meet customers desires with less expense.

5 Claims, 3 Drawing Sheets

KEYBOARD FOR CASH REGISTERS AND OTHER REGISTERS

BACKGROUND OF THE INVENTION

This invention concerns a keyboard for cash registers and other registers of a type having keys with long-strokes for keying in significant functions and other keys with shorter strokes.

Such keyboards are found in cash registers, such as a well known cash register TK 2200 of the firm CASIO. Specific keys of this cash register, with which important switching functions are entered, have a greater switching stroke, whereby it is avoided that they are inadvertently switched, or activated, by light touches.

Sales, or cash, registers and other registers are arranged and shaped for various needs, and structural refittings are often required to accommodate unusual desired arrangements.

It is an object of this invention to provide a generic keyboard which can be modified, without undue structural expenses, for achieving virtually every desirable arrangement of keys having long and/or short strokes.

SUMMARY

According to principles of this invention, with all keys of a keyboard having a uniform key spacing, each key having a shorter stroke is mounted on a lever having a short key moment arm and a long switch moment arm thereby forming a short-stroke rocker key assembly, and each key having a long stroke is mounted on a lever having a long key moment arm and a short switch moment arm, thereby forming a long-stroke rocker key assembly, wherein, in a mounted condition, a long stroke rocker key assembly lies within with a forked lever of a respective adjacent long stroke rocker key assembly.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
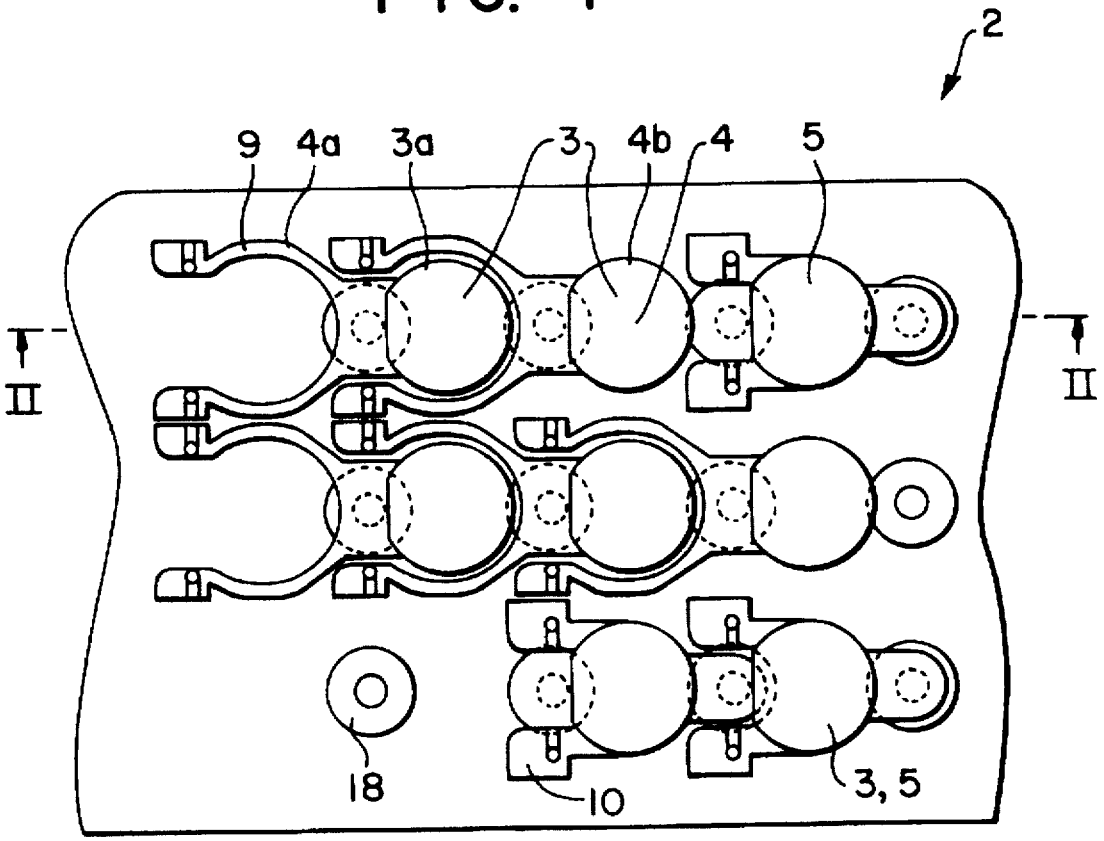
FIG. 1 is a top view of a keyboard of this invention having an open housing.

FIG. 1 shows a keyboard for cash registers, or other registers, having a key area 2 with keys 3 which are part of long-stroke rocker, or see-saw, key assemblies 4 and with keys 3 which are part of short-stroke rocker key assemblies 5.

It is provided that, with all of the keys 3 having a uniform spacing, the short-stroke rocker key assemblies 5 have a short key lever moment arm 7, and a long switch lever moment arm 8; while the long-stroke rocker key assemblies 4 have a long key moment arm 7' and short switch moment arm 8'(FIGS. 6 and 7); with some of the keys 3*a* of the long-stroke rocker key assemblies 4*a*, when mounted, lying within bifurcated ends of forked levers 9 of respectively adjacent long-stroke rocker key assemblies 4*b*.

Figure 2:
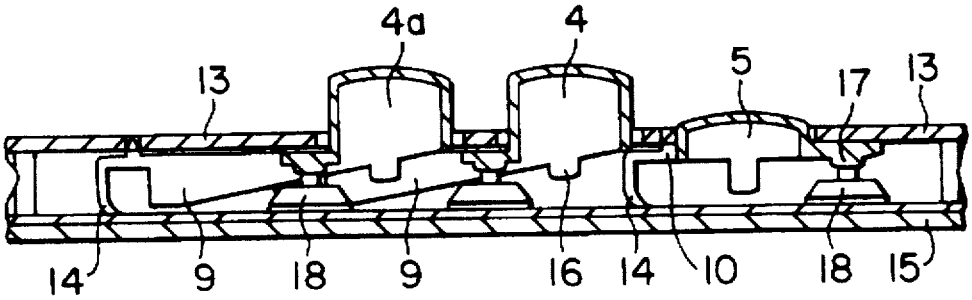
FIG. 2 is a cross-sectional view taken on line II—II in FIG. 1.
Figure 3:
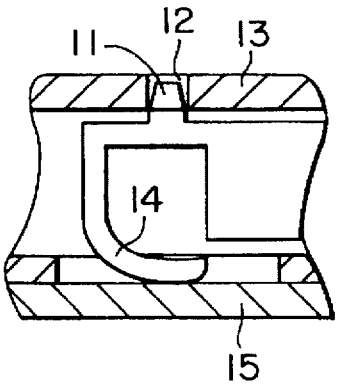
FIG. 3 is a segmented, enlarged view of a portion of FIG. 2.

As can be seen in FIGS. 2 and 3, both forked ends of the bifurcated forked levers 9, as well as of the bifurcated forked levers 10 of the short-stroke rocker key assemblies 5, have: somewhat barrel, or tapered shaped guiding lugs 11 which engage in guiding openings 12 of a guiding frame/housing 13 and glide surface members 14 which correspond in shape to a movement radius of the rocker key assemblies 4, 5 within the guiding frame/housing 13 and a support plate 15 in which they are springingly (in tension) held when they are mounted.

In order to limit stroke motion, both rocker key assemblies 4, 5, in areas of the keys 3, have stop lugs 16 which cooperate with supports, for example contact mats 18 or the support plate 15.

The long-stroke rocker key assemblies, which are on the left side of FIG. 2, relate to the more important functions of the keyboard, and the short-stroke rocker key assemblies 5, which are on the right side, are for more normal functions.

FIG. 3 shows, as described above, the arrangement of the guiding lug 11 and the glide surface member 14 within the guiding frame/housing and the support plate 15. The tensioned glide surface member 14 provides play-free guidance of the bifurcated forked levers 9, 10.

Figure 4:
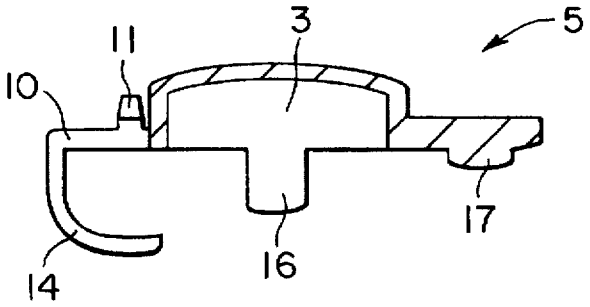
FIG. 4 is a cross-sectional view of a short-stroke rocker key assembly of this invention.

FIG. 4 depicts a cross section of a short-stroke rocker key assembly 5 with one of its guiding lugs 11, one of its glide surface members 14, its key 3, its stop lug 16, and its switch terminal 17, which, as shown in FIG. 2, cooperates with a contact mat 18.

Figure 5:
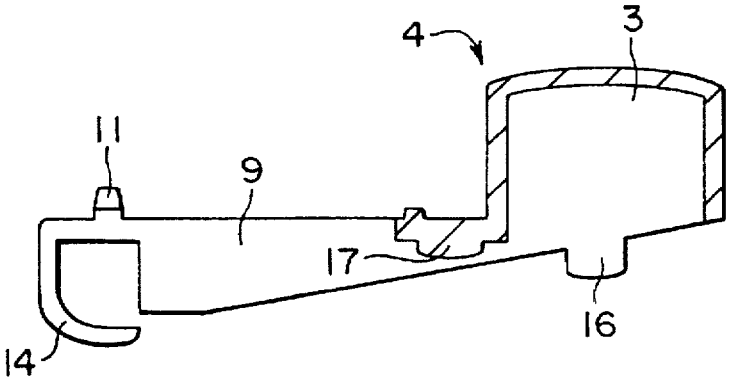
FIG. 5 is a cross-sectional view of a long-stroke rocker key assembly of this invention.

FIG. 5 depicts a long-stroke rocker key assembly 4 with the same features, with the key 3 thereof, however, being spaced further from the guiding lug 11 than is the switch terminal 17.

Figure 6:
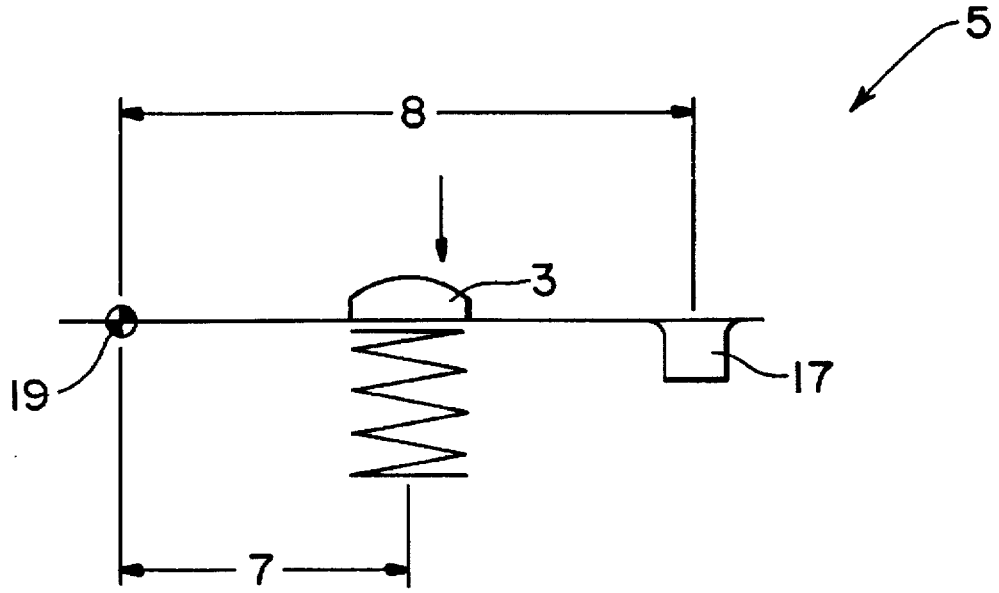
FIG. 6 is a schematic diagrammatic view demonstrating operation of the short-stroke rocker key assembly.
Figure 7:
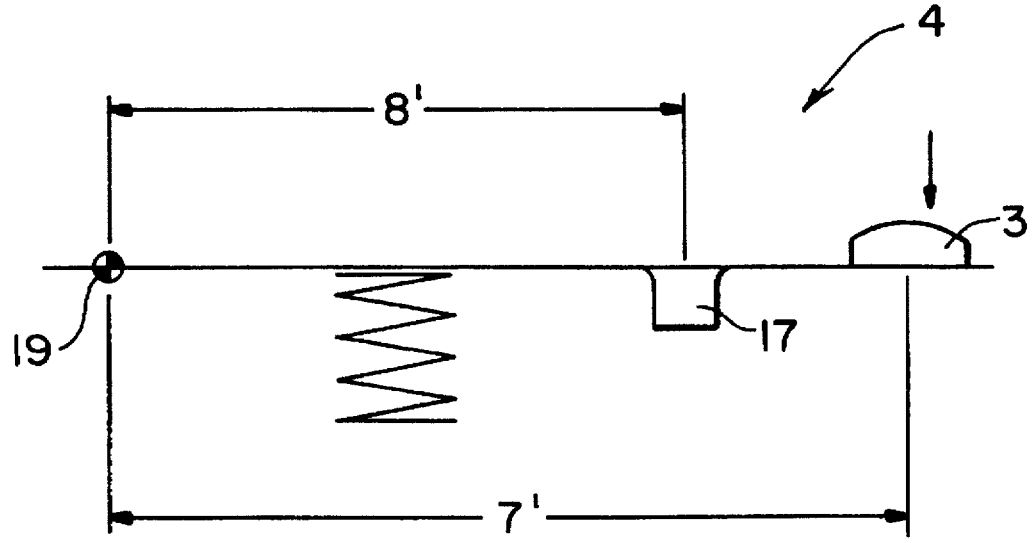
FIG. 7 is a schematic diagrammatic view demonstrating operation of the long-stroke rocker key assembly.

FIGS. 6 and 7 respectively show the long-stroke rocker key assembly 4 and the short-stroke rocker key assembly 5 schematically, with designations of the key moment arms 7, 7' as well as the switch moment arms 8, 8' relative to the guiding lugs 11, which in a mounted condition, form lever fulcrums 19 within the guiding openings 12.

This invention allows desired combinations of areas of long-stroke keys or short-stroke keys.

In this manner, technical, structural and fabrication expenses for meeting needs of customers are avoided because component parts of the keyboard can be standardized.

While the invention has been particularly shown and described with reference to a preferred embodiment, it will be understood by those of ordinary skill in the art that various changes in form and detail may be made therein without departing from the spirit and scope of the invention.

The invention claimed is:

1. A keyboard for sales and cash registers and the like having key areas provided with keys having long-strokes for keying in significant functions and keys having shorter strokes;

wherein, with all of the keys having uniform spacing, each of the keys having a shorter stroke is mounted on a short-stroke lever having a short key moment arm and a long switch moment arm, thereby forming a short-stroke rocker key assembly, and each of the keys having a longer stroke is mounted on a long-stroke lever with a long key moment arm and a short switch moment arm, thereby forming a long-stroke rocker key assembly, wherein, a first long-stroke lever of a first long-stroke rocker key assembly is a forked lever and wherein in a mounted condition, a key of a second long-stroke rocker key assembly, adjacent said first long-stroke rocker key assembly, lies within a gap formed between bifurcated ends of said forked lever of said first long-stroke rocker key assembly, whereby, said key of said second long-stroke rocker key assembly has the same uniform spacing from a key of said first long-stroke rocker key assembly as do other keys having shorter and longer strokes so that positions of said keys having long strokes can be interchanged with keys having shorter strokes on said key areas while maintaining said uniform spacing.

2. A keyboard as in claim 1 wherein there is at least a first short-stroke rocker key assembly having a first short-stroke lever which is constructed as a forked lever, and wherein each forked end of each of said forked levers has a somewhat tapered guiding lug which engages in a guiding opening of a guiding frame/housing and has a glide surface member which conforms to a movement radius of each of the respective rocker key assemblies within the guiding frame/housing and a support plate, in which they are springingly held.

3. A keyboard as in claim 1 wherein both long and short rocker key assemblies have stop lugs near their keys which cooperate with the support plate.

4. A keyboard as in claim 1 wherein all of the long rocker key assemblies have long-stroke levers formed as bifurcated fork levers.

5. A keyboard as in claim 1 wherein all of the long and short rocker key assemblies have long and short-stroke levers formed as bifurcated fork levers.

* * * * *